United States Patent [19]

Hassell et al.

[11] Patent Number: 5,074,776

[45] Date of Patent: Dec. 24, 1991

[54] PAPER-COATING

[75] Inventors: Morgan V. Hassell; Frederick J. Stephens, both of Cornwall; Ernest J. Edwards, Kenilworth; Michael A. Ball, Cornwall, all of England

[73] Assignee: ECC International Limited, United Kingdom

[21] Appl. No.: 435,773

[22] Filed: Nov. 13, 1989

[30] Foreign Application Priority Data

Nov. 11, 1988 [GB] United Kingdom ..... 8826439

[51] Int. Cl.[5] ..... B05B 3/14; B05C 3/18

[52] U.S. Cl. ..... 118/256; 118/321; 118/322; 118/323; 118/410; 118/419

[58] Field of Search ..... 118/106, 123, 125, 126, 118/321, 322, 410, 409, 413, 416, 419, 423, 258, 323, 261, 256, 257, 262; 425/382.4, 197

[56] References Cited

U.S. PATENT DOCUMENTS

| | | | |
|---|---|---|---|
| 3,521,602 | 7/1970 | Coghill | 118/410 |
| 4,340,011 | 7/1982 | Wahren et al. | 118/410 |
| 4,387,663 | 6/1983 | Alheid | 118/413 |
| 4,398,494 | 8/1983 | Alheid | 118/413 |
| 4,405,661 | 9/1983 | Alheid | 118/413 |
| 4,594,963 | 6/1986 | Krautzberger | 118/610 |
| 4,688,516 | 8/1987 | Sommer | 118/410 |
| 4,702,196 | 10/1987 | Kratzberger | 118/410 |
| 4,791,879 | 12/1988 | Eklund et al. | 118/413 |
| 4,836,134 | 6/1989 | Knop | 118/413 |

FOREIGN PATENT DOCUMENTS

| | | |
|---|---|---|
| 1032536 | 8/1966 | United Kingdom . |
| 2106015 | 4/1983 | United Kingdom . |

*Primary Examiner*—Jay H. Woo
*Assistant Examiner*—Khanh P. Nguyen
*Attorney, Agent, or Firm*—Klauber & Jackson

[57] ABSTRACT

There is disclosed an apparatus for coating sheet material. The apparatus includes a rotatable backing roll (4) upon which a sample of sheet material may be mounted to form a cylinder, a coating head (9) including a blade (22), an outlet (**21*b*) for dispensing a coating composition and a supply means (18) for supplying a coating composition to the outlet (21*b*) in the region of the coating edge of the blade (22), and means for enabling the coating head (9) to be moved in operation parallel to the axis of rotation of the backing roll (4) and in contact with the sheet material mounted thereon whilst the backing roll (4) is rotated, whereby a strip of sheet material may be coated of resultant helical form, wherein the supply means (18) includes an element which comprises a matrix of tubular passageways (19) longitudinally disposed with respect to the flow of coating composition through the coating head (9**).

10 Claims, 3 Drawing Sheets

PAPER-COATING

This invention relates to apparatus for, and a method of, coating paper and like fibrous sheet materials and, in particular, relates to a paper-coating apparatus of the type in which the coating head is movable, in operation, parallel to the axis of rotation of a backing roll supporting a sheet material, whereby a helical strip of sheet material may be coated.

Our British Patent No. 1032536 discloses an apparatus for coating sheet material, the apparatus comprising a rotatable backing roll upon which a sample of sheet material may be mounted to form a cylinder, a coating head which includes a blade and a reservoir for reception of a coating composition, and means for enabling the coating head to be moved in operation parallel to the axis of rotation of the backing roll and in contact with the sheet material mounted thereon whilst the backing roll is rotated, whereby a helical strip of sheet material in resultant helical form may be coated. This apparatus is suitable for use in the analysis of the rheological properties of coating compositions applied under conditions corresponding to those obtaining in conventional paper-coating machines or full scale paper-coating machines, since it is possible to mimic the manner in which a pilot or full scale paper-coating machine operates. Thus, relatively high speeds of, for example, up to at least 1500 m/minute between the sheet material and the coating head can be achieved, corresponding to the order of magnitude of coating velocities employed in pilot and full scale machines. However, the arrangement disclosed in our earlier British patent is of a type in which the coating composition is supplied from a "puddle" defined by the head and the surface to be coated. Such an arrangement does not mimic the latest type of coating composition applicators known as the "short dwell" applicators used in current pilot and full scale paper-coating machines. In the short-dwell arrangement, the coating composition is supplied to an outlet in the head in the region of the coating edge of the blade. In this arrangement, the cylinder on which the sheet material is mounted is adapted to rotate such that the surface of the cylinder adjacent the head is moving upwards. The coating composition flowing from the outlet flows into a region adjacent the coating surface and is held or supported in that region by the upward movement of the coatable material surface. The upward movement of the coatable surface causes coating composition to be drawn under and past the coating blade, which in turn causes the composition to be applied to the surface in the desired manner.

Although it may be possible to mimic the operation of a short-dwell apparatus on a helical coating apparatus of the general type described in our British Patent No. 1032536, by specific modifications to the head, problems arise especially when it is desired to apply a coating composition at particularly high coating speeds, for example, up to at least 1500 m/minute. In such instances, the coating head must be caused to move parallel to the axis of rotation of the backing roll at high speed, typically over a distance of one meter in less than one second. The initial acceleration as the coating head begins the sweep across the apparatus is very high and a "surge" effect is created whereby this lateral movement of the coating composition may be such as to prevent uniform supply of coating along the entire width of the blade over the duration of the coating head traverse across the backing roll.

GB-A-2106015 relates to a short-dwell, fountain type coating apparatus which is said to be capable of delivering the coating material uniformly right across the full length of the blade edge. This is achieved by providing a series of ports which are relatively large in diameter, although they are relatively few in number.

In accordance with a first aspect of the present invention, there is provided an apparatus for coating sheet material, the apparatus comprising a rotatable backing roll upon which a sample of sheet material may be mounted to form a cylinder, a coating head including a blade, an outlet for dispensing a coating composition and a supply means for supplying a coating composition to the outlet in the region of the coating edge of the blade, and means for enabling the coating head to be moved in operation parallel to the axis of rotation of the backing roll and in contact with the sheet material mounted thereon whilst the backing roll is rotated, whereby a strip of sheet material may be coated of resultant helical form, wherein the supply means includes an element which comprises a matrix of tubular passageways longitudinally disposed with respect to the flow of coating composition through the coating head.

According to a second aspect of the present invention, there is provided a method of coating sheet material, the method comprising rotating a sheet material in the form of a cylinder about the axis of the cylinder and applying a coating to the sheet material by a coating head which includes a blade, an outlet for dispensing a coating composition and a supply means for supplying a coating composition to the outlet in the region of the coating edge of the blade, wherein said supply means includes an element comprising a matrix of tubular passageways longitudinally disposed with respect to the flow of coating composition through the coating head, the head being moved parallel to the axis of the cylinder whilst the latter is rotated, thereby applying the coating composition to the cylinder of sheet material to enable strips of coated material to be produced of resultant helical form.

The passageways or tubes are each of a relatively narrow dimension so as to ensure the provision of a substantially uniform and non-disturbed flow of coating composition to the coating blade and further to eliminate or substantially reduce the "surge" effect.

The matrix of tubular passageways is typically very much wider than it is deep. The passageways, of which there are typically of the order of 30 to 60 may be arranged in a few rows (for example 2, 3 or 4 rows) which may overlap slightly. The width of the matrix is however, limited by the width of the blade. The object is to supply a thin flow of coating to the blade and it is for this reason that the matrix is of the shape described above. The arrangement of passageways described tends to encourage a laminar flow at the blade, thereby ensuring even distribution. The passages are evenly spread across the width of the matrix element and they are preferably generally circular in cross-section. Each is preferably no greater than 8 mm in diameter, more preferably in the range 2 to 6 mm. The number of passageways per unit area (i.e. 1 sq. meter) is preferably in the range of $1.25\times10^4$ to $5\times10^4$, more preferably about $2\times10^4$ per $m^2$. Thus, in an element about 150 mm by 15 mm, there are preferably about 40 to 50 passageways.

The passageways are of a length to suit the particular coating conditions to be used; however, by way of example, in a heli-coating situation, the passageways may be of the order of 20 to 100 mm in length, typically about 40 mm in length.

Preferably, between the outlet of the supply means and the element comprising a matrix of tubular passageways, there is provided a throat having a cross-section which is in the shape of a venturi. The constrictive effect of the venturi throat itself creates a back pressure serving to reduce flow surge with the venturi geometry also ensuring minimal flow disturbance, thereby maintaining flow alignment if not even a laminar flow pattern.

Upstream of the matrix of passageways, there may be a chamber which acts as an initial buffer for the coating composition. This chamber is preferably immediately upstream of the matrix of passageways. The chamber may be provided with a means for suppressing transverse flow of coating composition in the chamber. This means for suppressing transverse flow may preferably be at least one baffle, which subdivides the chamber, each of the at least one baffle extending across the chamber generally in the direction of flow of liquid through the head. The or each baffle is provided with a series of apertures which permit the coating composition to percolate through from one side to the other and reduces the tendency of the coating composition to surge across the coating head. The apertures in the or each baffle may be generally circular and are preferably of the order of up to 5 mm in diameter and there may be up to, for example, 20 such apertures provided in the baffle. Preferably, there is one baffle in the chamber.

Figure 1:
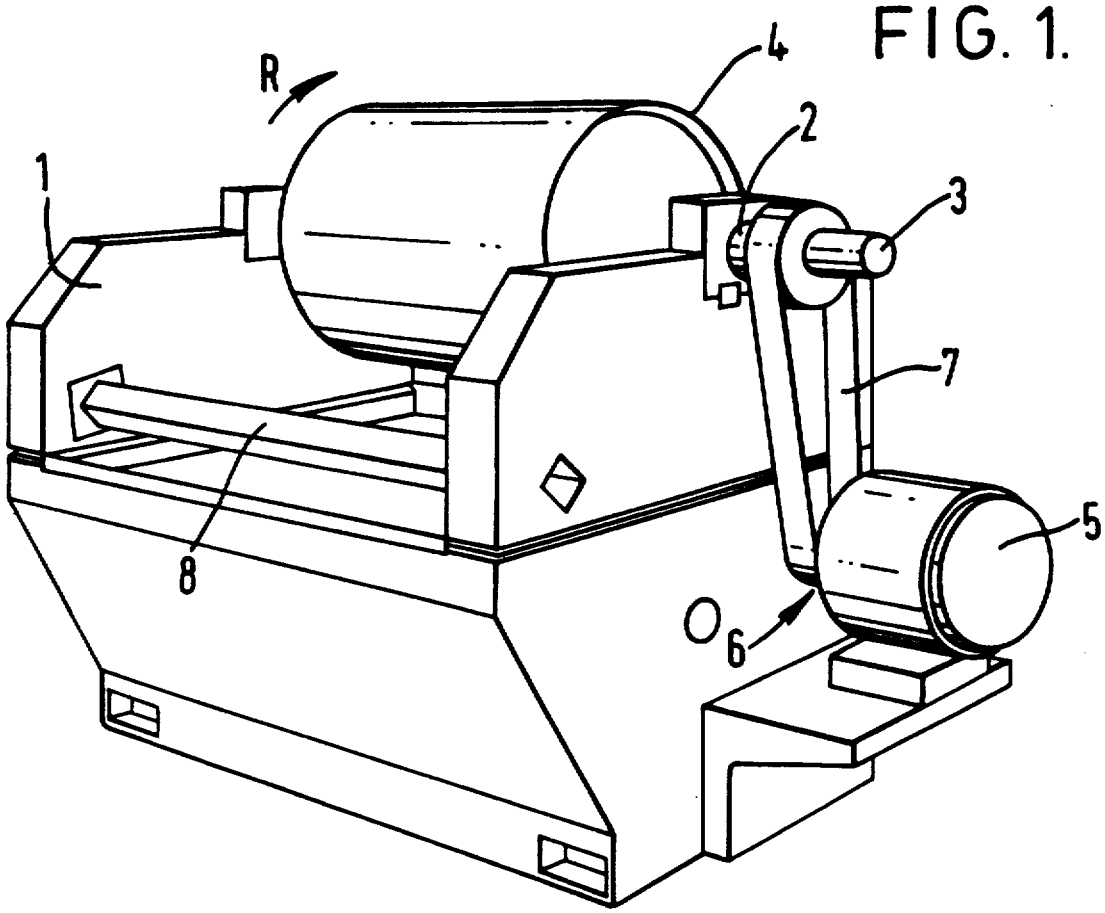
FIG. 1 is a general perspective view of an apparatus for coating sheet material, the coating head being omitted for clarity.

The apparatus shown in FIG. 1 comprises a frame 1 on which are mounted two aligned bearing blocks 2. An axle 3 for a rubber-faced backing roll 4 is mounted for rotation in the bearing blocks 2. The backing roll 4 may be driven in the direction indicated by arrow R by a variable speed drive electric motor 5, pulleys and a belt 7. A diamond-shaped carriageway or cross beam 8 is mounted on the frame 1 so as to extend parallel to the horizontal axis of the axle 3 and at a level below such axis.

Figure 4:
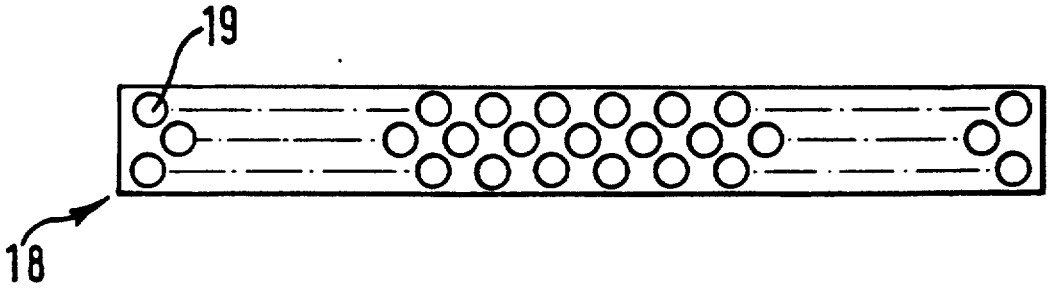
Figure 2:
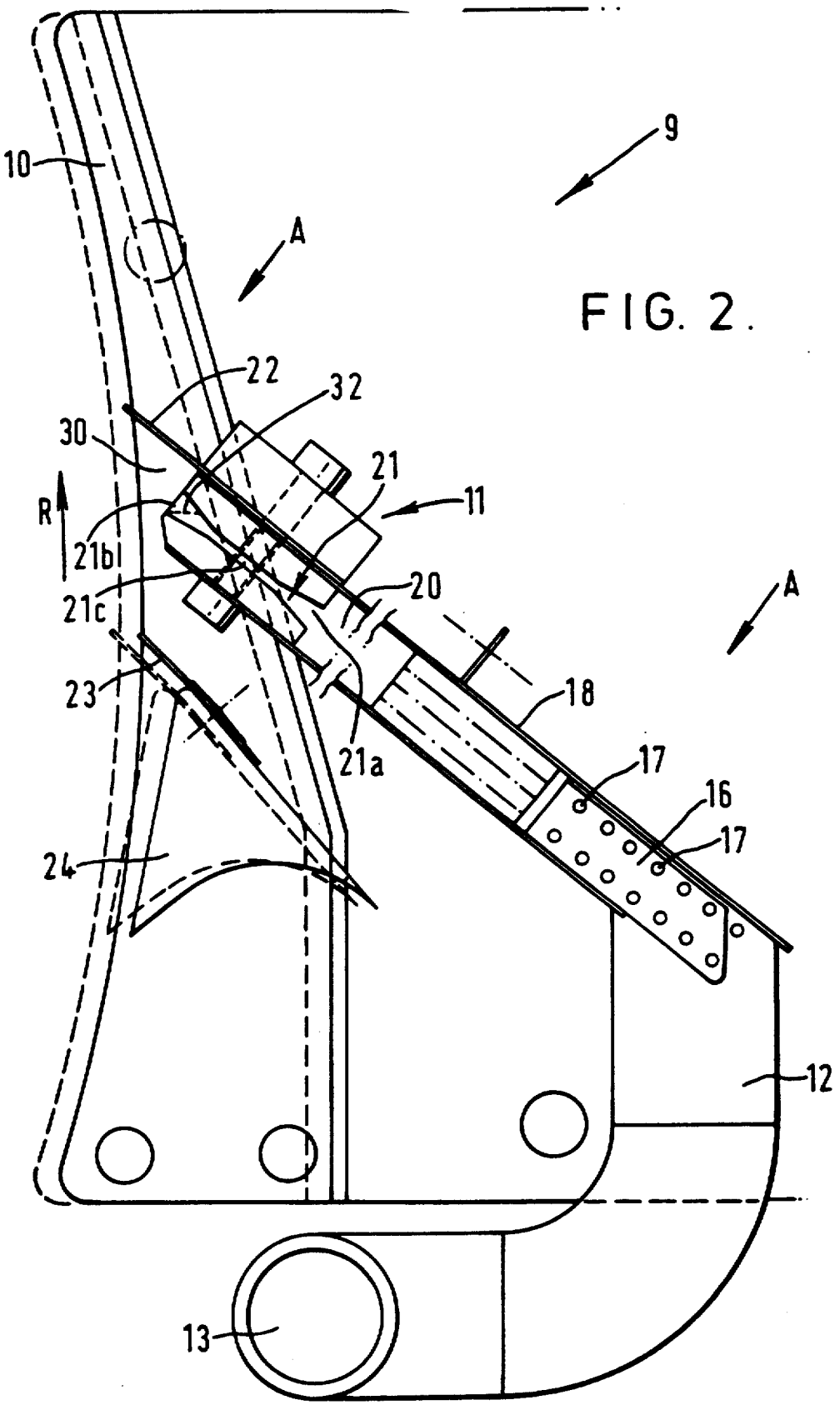
FIG. 2 is a side view of a coating head in accordance with the present invention fixed to the cross beam of the apparatus shown in FIG. 1.
Figure 3:
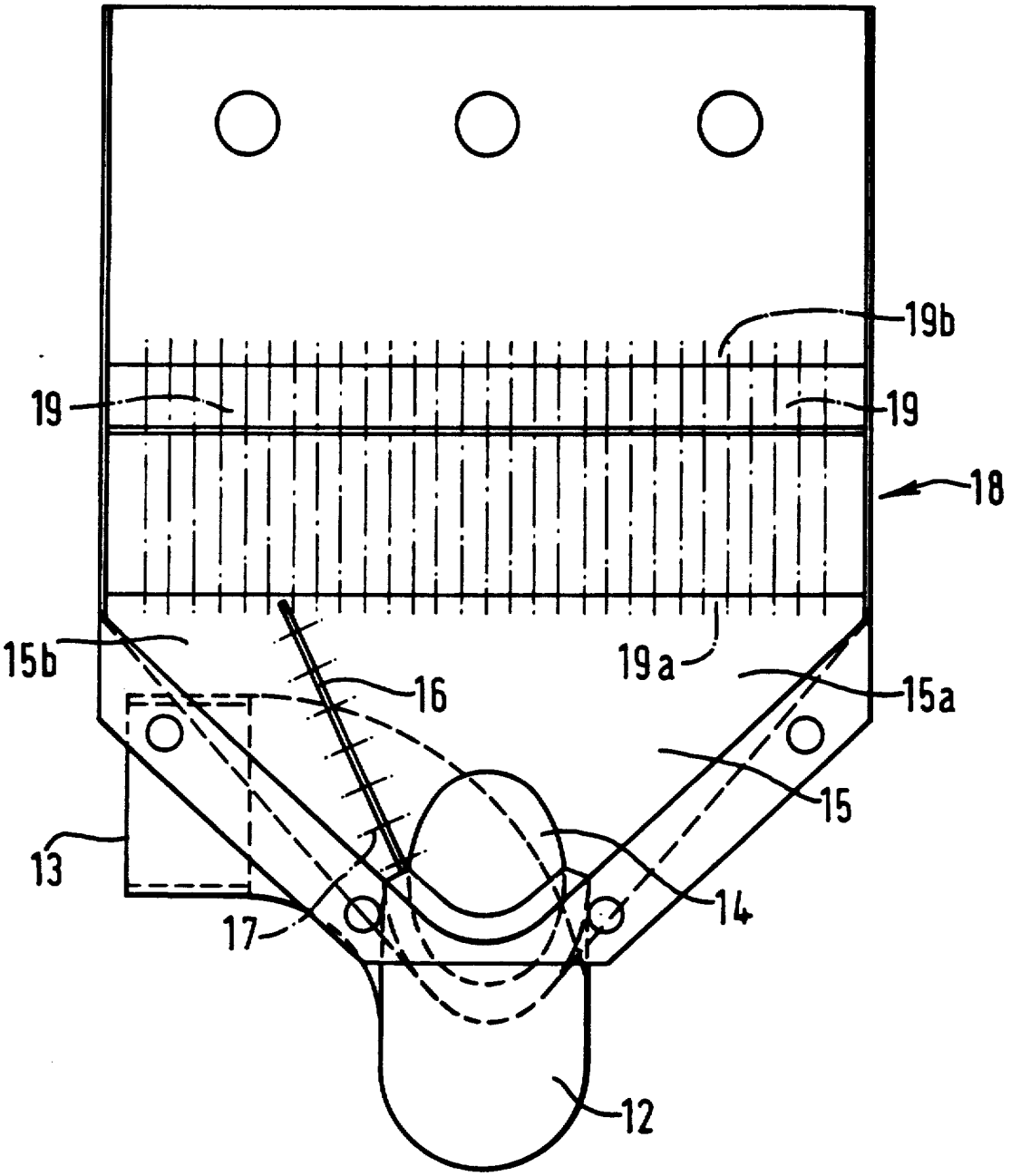
FIG. 3 is a view in the direction A-A of FIG. 2.

Part of a coating head 9 suitable for use on the paper coating apparatus shown in FIG. 1, is illustrated in FIGS. 2 and 3. The mechanism by which the head 9 is mounted to the carriageway 8 is not shown but may be of typical construction permitting detachable connection of the head 9 to a mounting platform itself slideably secured to the carriageway 8, and further permitting pivotal movement of the head towards and away from the drum 4. The head 9 is capable of being driven on the carriageway 8 in a direction parallel to the axis of rotation of the backing roll 4. The mechanism by which the head 9 is driven on the carriageway 8 is not shown but may be of typical construction. The head 9 comprises a frame member which supports a coating composition delivery mechanism 11 which is inclined upwardly toward the side of the member 10 which is to lie adjacent (but not touching) the drum 4 in the coating apparatus. The coating mechanism 11 is supplied by a feed pipe 12 having a circular bore 13. The feed pipe 12 has an open end 14 (see FIG. 3) which opens into a first region or chamber 15 in the coating mechanism 11. This first chamber 15 includes a means for suppressing transverse flow of coating composition in the form of a baffle 16 which is pierced by apertures 17 (see FIG. 3). The baffle 16 divides chamber 15 into two separate parts, namely sub-chambers 15*a* and 15*b*. Communicating with the first chamber 15 is a second region 18 comprising a matrix of longitudinal tubes 19 (see FIG. 4). Each of these tubes is open at both ends 19A and 19B. In the matrix element 18 shown in FIG. 4 by way of example, the passageways 19 may have a diameter of 4 mm and there may be of the order of 42 passageways arranged in three overlapping rows in an area of about 150 mm to 15 mm. Communicating with the second region 18 is a further region or chamber 20. Upstream of chamber 20 is a passageway 21 having a venturi-shaped configuration as viewed in cross-section. Thus, the downstream end of chamber 20 comprises the wider upstream opening 21*a* of passageway 21 and which narrow central portion 21*c* terminates in a wider downstream opening 21*b*. Secured at the downstream end of the coating mechanism 11 is a blade 22 which projects beyond the front of the body 10. Directly below the coating mechanism 11 is a membrane 23 carried by a support 24 itself secured to the frame member 10.

Although not shown for the sake of clarity, the coating head as shown in FIG. 2 includes two side pieces secured by cross members. The side pieces are spaced apart by the width of the blade. These side pieces enclose the head 9 and form a seal with the surface to be coated. They are precision machined such that their front surfaces or edges match the curvature of the drum. The side pieces are preferably provided with a surface formed from a highly heat conductive material, for example a metal such as stainless steel. The front edges may be highly polished to reduce friction. More details of this aspect of the coating head may be gained from our co-pending British Patent Application No. 8825908.0 entitled "Paper Coating" filed on the 4th Nov. 1988.

In operation, once the drum 4 has reached the required operating speed, the coating head 9 is moved toward the drum 4 (see FIG. 1) (on which there is fastened a sample of sheet material, e.g. paper) by the coating head mounting mechanism (not shown). As the coating head 9 is moved toward the drum 4, the blade 22 and membrane 23 will contact the rotating drum whence a coating composition is pumped from the pipe 12 through the coating mechanism 11 to a region 30 immediately beyond the outlet 21*b* of the venturi 21. This region 30 can be viewed as a tiny "reservoir" of coating composition bounded at its sides by the side pieces (not shown), at the top by the blade 22, at the front by the sheet member being coated and, at the bottom, by the membrane 23. The back of the "reservoir" or region 30 is a dynamic fluid boundary and is determined by the rate of supply of coating composition through the head and the velocity of the surface of the drum. In order to minimise delay between the action of pumping the coating composition and the moment at which the coating composition is to be applied, the head is arranged such that it is full of coating composition immediately before a coating cycle takes place. Thus, the coating composition will be maintained, before coating, at the level shown by the dotted line 31 in FIG. 2. As the coating composition enters the region 30, it will be immediately taken up by the upward rotating movement of the drum 4 during its application to the material to be coated. Any coating composition not being applied in this way drains by gravity and is directed away from the surface of the sheet member by the membrane 23. It will thus be seen that the coating composition is in contact with the sheet member for only a very short length of time, namely the time the drum takes to move from the point of contact of the blade 22 to the point of contact of the membrane 23 with the sheet member on the drum 4. It is for this reason that this type of coating head is known as a "short-dwell" head.

Returning to the route of the coating composition through the coating head, it is to be appreciated that one of the problems of a coating apparatus of the type shown in FIG. 1 is that the coating head must move, for each coating cycle, translationally on the carriageway 8 with respect to the drum 4. With the desire to mimic very high coating application velocities, the head may have to traverse the carriageway 8 in under a second and this can lead to "surging" of the coating composition in the head. It is for this reason that the coating mechanism 11 is provided with two distinct features, namely the apertured baffle 16 and the tubular matrix 18.

The baffle 16 prevents coating composition within the chamber 15 from accumulating at the left hand side (as seen in FIG. 3) of the chamber 15, i.e. in the sub-chamber 15*b*. The apertures 17 tend to slow down translational movement of the coating composition to the sub-chamber 15*b*. Typically, the apertures 17 have a diameter of 2.5 mm and there may be of the order of 14 such apertures in two rows with 7 mm aperture centre spacing piercing one baffle 16.

As regards the tubular matrix 18, the tubes 19 further serve to prevent the coating composition from surging to the left, as viewed in FIG. 3. Typically, the passageways are about 38 mm in length and about 4 mm in diameter. The most important function of tubes 19 however is to ensure that substantially uniform and non-disturbed flow of coating composition is presented to the blade 22.

The passage 21 functions as a venturi and offers advantages during operation of the coating head as described above.

Although this head has been described in relation to a coating apparatus known as the HELI-COATER (UK Registered Trade Mark No. 940752) i.e. that described in our British Patent Specification No. 1032536, it is to be appreciated that the above coating head arrangement may be suitable for use with types of coating apparatus, other than HELI-COATER paper coating apparatus.

We claim:

1. Apparatus for coating sheet material, comprising:

(i) a rotatable backing roll upon which a sample of sheet material is mountable to form a cylinder, said backing roll having a longitudinal axis of rotation;

(ii) a coating head mounted adjacent the rotatable backing roll, said coating head including (a) a blade having a coating edge, (b) an outlet for dispensing a coating composition into a region where it is capable of being coated, in operation, onto the sheet material mounted upon the backing roll to coat said sheet material and (c) a supply means for supplying said coating composition to the said outlet, said supply means including an element which comprises a matrix of tubular passageways longitudinally disposed with respect to the flow of coating composition through the coating head; a chamber which includes a means for suppressing transverse flow of coating composition in the chamber being provided upstream of the passageways; and (iii) means for enabling the coating head to be moved, in operation, parallel to the axis of rotation of the backing roll and with the coating edge of the blade in contact with the sheet material mounted thereon while the backing roll is rotated, whereby a strip of sheet material is coated with the coating composition, the resultant coated strip being of helical form.

2. Apparatus according to claim 1, wherein said chamber comprises:

at least two sub-chambers;

a baffle extending generally perpendicular to the axis of rotation of the backing roll and dividing the chamber into said at least two sub-chambers; and aperture means in said baffle adapted to limit the rate at which, in operation, the coating composition is capable of passing between said sub-chambers, thereby suppressing flow of coating composition in the chamber in the direction of movement of the coating head parallel to the axis of rotation.

3. An apparatus as claimed in claim 1, wherein each of the passageways is of a relatively small cross-sectional area compared to the cross-sectional area of the head.

4. An apparatus as claimed in claim 1, wherein the number of passageways per square meter is in the range of from $1.25\times10^4$ to $5\times10^4$.

5. An apparatus as claimed in claim 1, wherein each passageway is no greater than about 8 mm in diameter.

6. An apparatus as claimed in claim 1, wherein the matrix of tubular passageways is very much wider than it is deep.

7. An apparatus as claimed in claim 1, wherein there is provided a throat having a cross-section in the shape of a venturi between the outlet and the matrix of tubular passageways.

8. An apparatus as claimed in claim 1, which includes a side plate either side of the blade between which plates a coating region or zone is defined, said side plates, which in use are to contact the surface to be coated, being formed from a highly heat conductive material.

9. Apparatus for coating sheet material, comprising:

(i) a rotatable backing roll upon which a sample of sheet material is mountable to form a cylinder, said backing roll having a longitudinal axis of rotation;

(ii) a coating head mounted adjacent the rotatable backing roll, said coating head including (a) a blade having a coated edge, (b) an outlet for dispensing a coating composition into a region where it is capable of being coated, in operation, onto the sheet material mounted upon the backing roll to coat said sheet material and (c) a supply means for supplying said coating composition to the said outlet, said supply means including an element which comprises a matrix of tubular passageways longitudinally disposed with respect to the flow of coating composition through the coating head;

(iii) means for enabling the coating head to be moved, in operation, parallel to the axis of rotation of the backing roll and with the coating edge of the blade in contact with the sheet material mounted thereon while the backing roll is rotated, whereby a strip of sheet material is coated with the coating composition, the resultant coated strip being helical form; and (iv) a chamber, upstream of the said matrix of passageways, said chamber comprising:

at least two sub-chambers;

a baffle extending generally perpendicular to the axis of rotation of the backing roll and dividing the chamber into said at least two sub-chambers; and aperture means in said baffle adapted to limit the rate at which, in operation, the coating composition is capable of passing between said sub-chambers, thereby suppressing flow of coating composition in the chamber in the direction of movement of the coating head parallel to the axis of rotation.

10. An apparatus for coating sheet material, comprising:

(i) a rotatable backing roll upon which a sample of sheet material is mountable to form a cylinder, said backing roll having a longitudinal axis of rotation;

(ii) a coating head mounted adjacent the rotatable backing roll, said coating head including (a) a blade having a coating edge (b), an outlet for dispensing a coating composition into a region where it is capable of being coated, in operation, onto the sheet material mounted upon the backing roll to coat said sheet material and (c) a supply means for supplying said coating composition to the said outlet, said supply means including an element which comprises a matrix of tubular passageways longitudinally disposed with respect to the flow of coating composition through the coating head;

(iii) means for enabling the coating head to be moved, in operation, parallel to the axis of rotation of the backing roll and with the coating edge of the blade in contact with the sheet material mounted thereon while the backing roll is rotated, whereby a strip of sheet material is coated with the coating composition, the resultant coated strip being of helical form; and (iv) a chamber, upstream of the matrix of passageways, said chamber including a means for suppressing flow of coating composition in the chamber in the direction of movement of the coating head parallel to the axis of rotation.

* * * * *